United States Patent [19]

Kusche

[11] Patent Number: 4,964,380

[45] Date of Patent: Oct. 23, 1990

[54] INDUCTION SYSTEM FOR A TWO-CYCLE ENGINE

[75] Inventor: David W. Kusche, Oshkosh, Wis.

[73] Assignee: Brunswick Corporation, Skokie, Ill.

[21] Appl. No.: 356,782

[22] Filed: May 24, 1989

[51] Int. Cl.[5] ..... F02B 33/04

[52] U.S. Cl. ..... 123/52 MF; 123/73 V; 137/855

[58] Field of Search ..... 123/52 M, 52 MV, 52 MC, 123/52 MF, 73 V; 137/855

[56] References Cited

U.S. PATENT DOCUMENTS

| | | | |
|---|---|---|---|
| 2,612,882 | 10/1952 | Kiekhaefer . | |
| 2,669,979 | 2/1954 | Kiekhaefer . | |
| 2,706,972 | 4/1955 | Kiekhaefer . | |
| 2,731,960 | 1/1956 | Kircher et al. . | |
| 2,804,861 | 9/1957 | Heidner . | |
| 2,815,559 | 6/1974 | Anderson | 123/73 V |
| 2,838,035 | 6/1958 | Rice . | |
| 4,406,697 | 4/1984 | Sakurai | 123/52 M |
| 4,408,579 | 10/1983 | Kusche | 123/73 V |
| 4,474,163 | 10/1984 | Linder et al. | 123/73 V |
| 4,691,671 | 9/1987 | Nishimura | 123/52 M |
| 4,784,090 | 11/1988 | Sougawa | 123/52 MV |

*Primary Examiner*—David A. Okonsky

*Attorney, Agent, or Firm*—Andrus, Sceales, Starke & Sawall

[57] ABSTRACT

An induction system for supplying air-fuel mixture to a two-stroke cycle crankcase compression engine is disclosed. The induction system includes an induction passage for each crankcase compartment, and a reed valve system disposed between the induction passage and the crankcase compartment. The reed valve system includes a reed block having a plurality of valve ports, with the ports being arranged in oppositely spaced sets. The ports are preferably arranged so that the ports in one set are radially opposite the ports in the other set. A single reed valve member is disposed between the induction passage and the crankcase compartment for normally closing the valve ports. The single reed valve member includes a series of petals extending outwardly from a central portion, with a section of reduced area therebetween for reducing the stiffness of the reed valve member. A flow modifying body is disposed upstream of the reed valve system for directing the air-fuel mixture into the ports as it flows through the induction passage.

13 Claims, 3 Drawing Sheets

FIG. 2
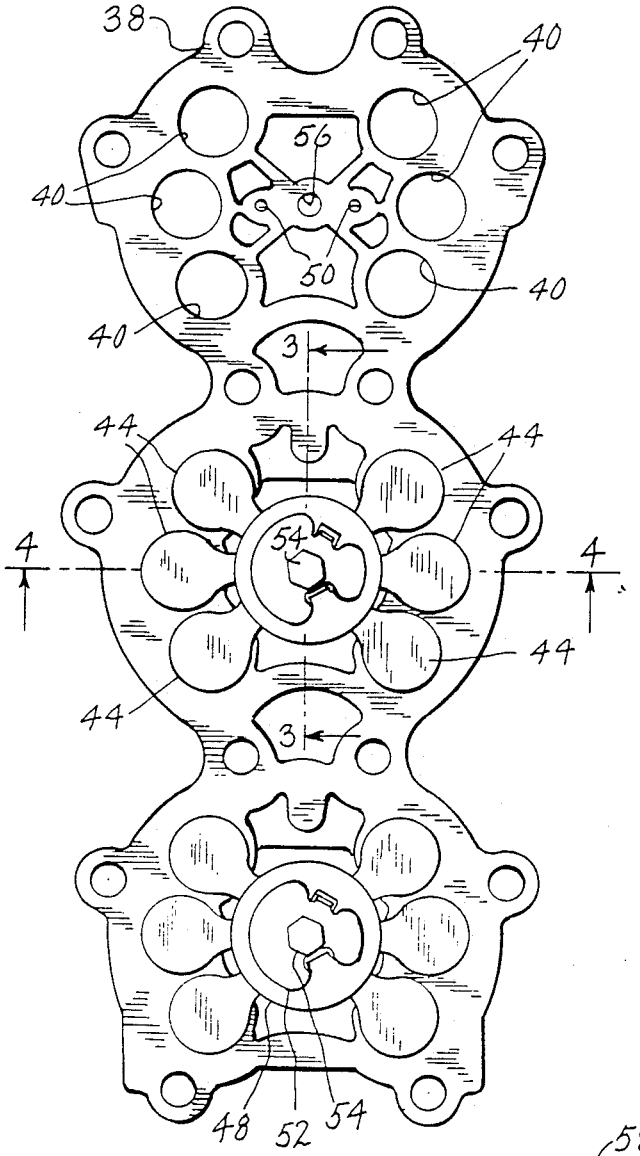
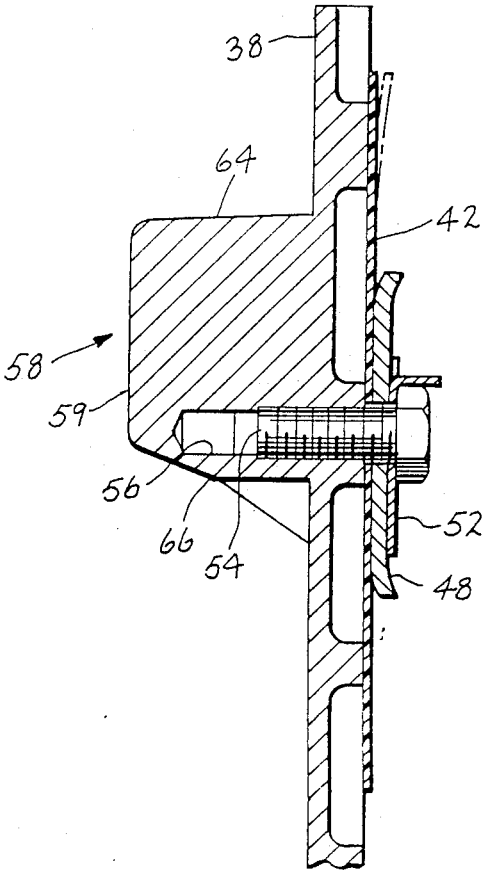
FIG. 3
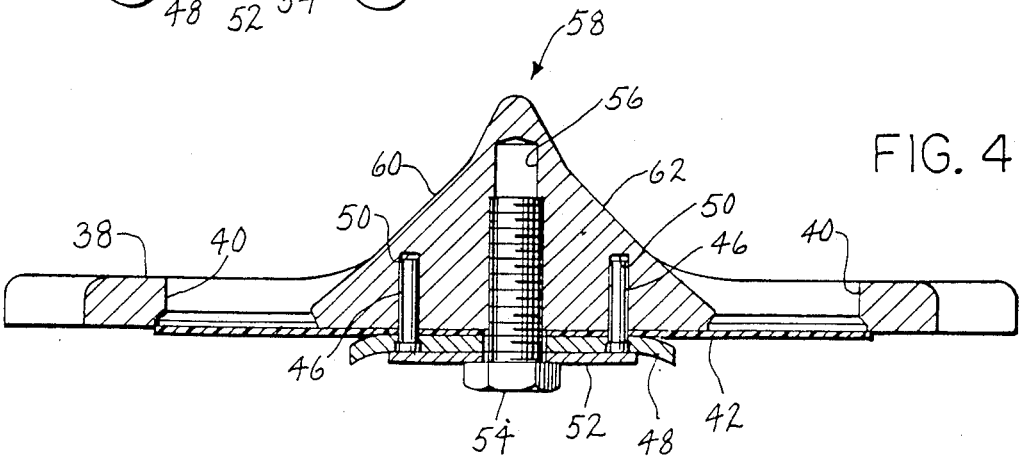
FIG. 4

INDUCTION SYSTEM FOR A TWO-CYCLE ENGINE

BACKGROUND AND SUMMARY

This invention relates to an induction system for supplying air-fuel mixture to a two-stroke cycle, crankcase compression internal combustion engine, and more particularly to such a system having a single carburetor barrel for each cylinder.

In large, two-stroke cycle crankcase compression engines, it has been found that a satisfactory induction system is provided by a reed valve system mounted in the induction passage. The reed valve system includes a valve seat member having a plurality of valve ports arranged in a generally circular pattern equidistant from the axis of the induction passage, and a plurality of reed valve members, each normally closing one of the valve ports and opening in response to low pressure within the crankcase to admit air-fuel mixture thereto. Such a system is disclosed in U.S. Pat. No. 4,408,579, the disclosure of which is hereby incorporated by reference. A flow modifying body is mounted in the induction passage immediately upstream from the reed valve system, to provide efficient flow to the crankcase while preventing spit back through the carburetor. With the reed valve system mounted to the engine crankcase, this type of induction system provides a shorter length than prior art systems employing a V-type reed block.

The induction system as disclosed in U.S. Pat. No. 4,408,579 provides a highly satisfactory structure and operation for a large two-stroke cycle engine, e.g. 70 to 115 horsepower. On such large engines, the induction system as disclosed in U.S. Pat. No. 4,408,579 is readily adapted to fit the center-to-center spacing of the cylinders, which is relatively large due to the large displacement of the engine.

The present invention addresses an induction system for a smaller two-stroke cycle engine, such as one providing 30 to 60 horsepower. In a smaller engine such as this, the center-to-center spacing of the cylinders is much closer than in the larger engines as described above. It has been found that the system as disclosed in U.S. Pat. No. 4,408,579 requires more space than is available on a smaller engine. However, the principle and operation of the induction system structure as disclosed in U.S. Pat. No. 4,408,579 have been found highly satisfactory. The present invention addresses the problem of applying the theory of the induction system as shown in U.S. Pat. No. 4,408,579 to a smaller horsepower engine.

In accordance with the invention, a two-stroke cycle crankcase compression engine includes a crankshaft, a crankcase surrounding the crankshaft, an induction passage for supplying air-fuel mixture to the crankcase, and reed valve means mounted in the induction passage. The induction passage is preferably formed in an induction manifold casting disposed upstream of the reed valve means. The reed valve means includes a valve seat member, preferably a reed block, having a plurality of valve ports. The reed block is a one-piece member, and valve ports for each induction passage are formed in the reed block. The valve ports are arranged in a plurality of oppositely oriented sets. Preferably, two sets of three valve ports are provided for each induction passage. The valve ports in one set are disposed radially opposite the valve ports in the other set, and all of the valve ports are preferably equidistant from a center point offset from the axis of the induction passage. A plurality of reed valve members are provided for each induction passage, each normally closing one of the valve ports and opening in response to low pressure within the crankcase to admit air-fuel mixture thereto. The plurality of reed valve members preferably comprise a series of petals formed on a single reed valve, with the petals being arranged so as to cover the valve ports for one of the induction passages. A flow modifying body is preferably mounted in the induction passage immediately upstream from the reed valve means, and a carburetor having a barrel is mounted upstream of the flow modifying body, with the barrel having an axis substantially aligned with the axis of the induction passage.

BRIEF DESCRIPTION OF THE DRAWINGS

The drawings illustrate the best mode presently contemplated of carrying out the invention.

In the drawings:

FIG. 2 is a bottom plan view of the reed block forming a part of the induction system of the invention, showing the upper two sets of valve ports with the reed valve removed;

FIG. 3 is a partial sectional view taken generally along line 3—3 of FIG. 2;

FIG. 4 is a sectional view taken generally along line 4—4 of FIG. 2;

DETAILED DESCRIPTION OF THE PREFERRED EMBODIMENT

Figure 1:
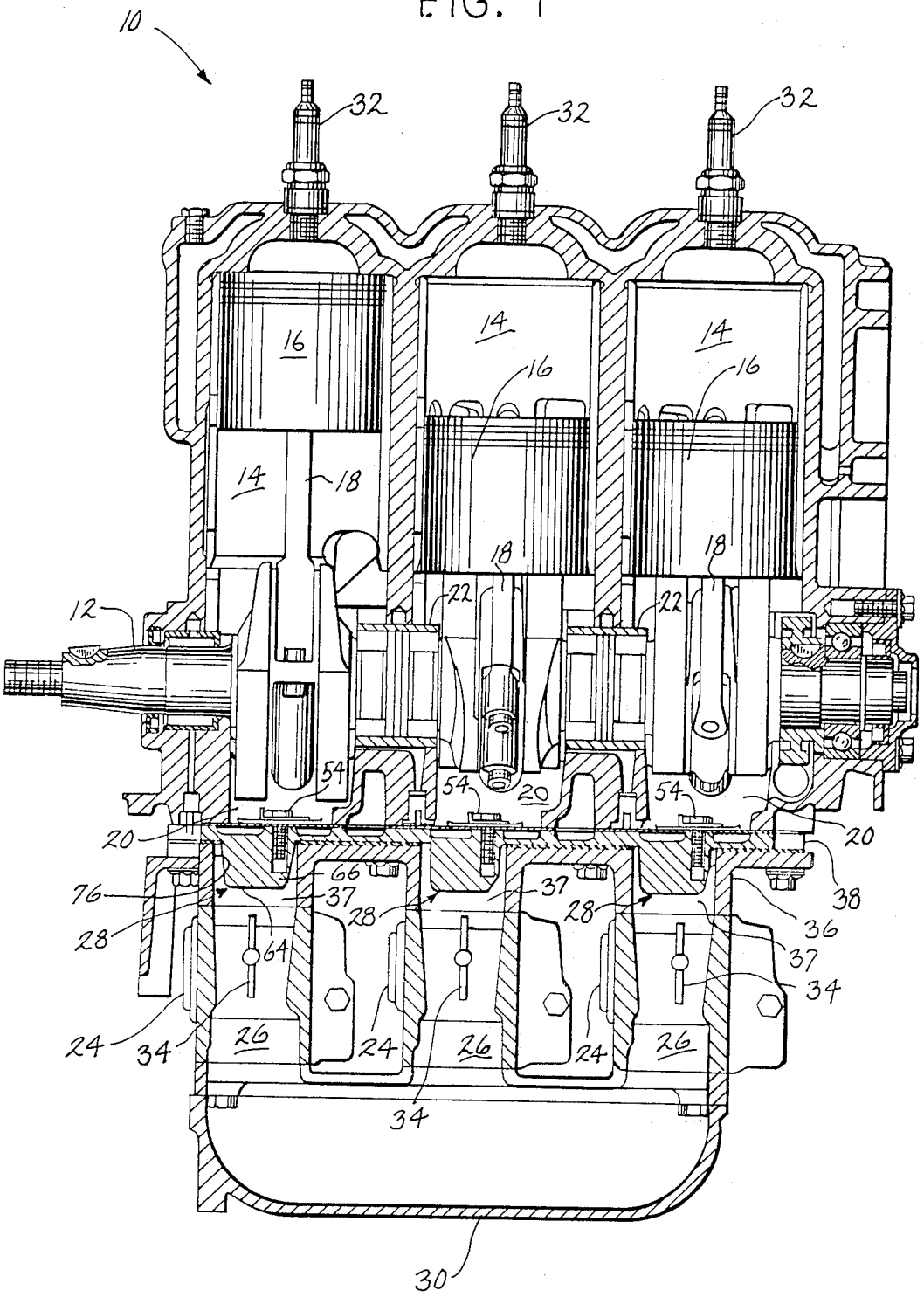
FIG. 1 is a sectional view of a two-stroke cycle crankcase compression engine incorporating the induction system of the invention.

FIG. 1 shows a three cylinder two-stroke cycle crankcase compression engine 10. Engine 10 is satisfactorily employed in an outboard motor. In such an application, the crankshaft 12 of engine 10 is oriented substantially vertically.

Engine 10 includes cylinders 14, each of which has a piston 16 slidably mounted therein. Pistons 16 are connected by connecting rods 18 to drive crankshaft 12. A separate crankcase compartment 20 is provided for each of the three cylinders 14, with the compartments 20 being separated from each other by crankshaft bearings 22.

Crankcase compartments 20 are alternately subjected to compression and expansion as pistons 16 reciprocate to provide a pumping action. Air-fuel mixture is supplied to each crankcase compartment 20 by three single barrel carburetors 24. Each carburetor 24 includes a barrel 26 with a venturi passage. Each carburetor 24 supplies one of the crankcase compartments 20 with air-fuel mixture through a reed valve means 28. A conventional air inlet silencer 30 is provided for the carburetor inlets. Air-fuel mixture is drawn into the crankcase compartments 20 on the piston upstroke and compressed and forced into the cylinders 14 through a loop charging system, not illustrated, on the piston downstroke. The air-fuel mixture is then compressed in the combustion chamber of cylinders 14, ignited by spark plugs 32, expanded in the downstroke of piston 16, and exhausted through exhaust ports, not illustrated, to complete a conventional two-stroke cycle.

Carburetors 24 serve to meter a mixture of fuel and air to provide the desired air-fuel ratio in a conventional manner. The flow of air-fuel mixture to crankcase compartments 20 is controlled by conventional throttle valves 34 mounted in the carburetor barrels 26 downstream from the venturis.

Carburetors 24 are supported on the engine crankcase by an induction manifold casting 36, which include axially symmetric induction passages 37 aligned with the axis of carburetor barrels 26. Induction passages 37 provide an inlet which matches the outlet of carburetor barrels 26.

A reed block 38 is mounted between induction manifold casting 36 and the crankcase of engine 10. Reed block 38 is an integral cast member, and spans substantially the entire length of the engine crankcase. With reference to FIG. 2, reed block 38 is formed so as to provide three valve seat lobes, each of which is disposed adjacent an inlet to one of the crankcase compartments 20. Each valve seat lobe includes oppositely spaced sets of inlet ports, shown at 40 on the upper lobe of reed block 38 (FIG. 2). Inlet ports 40 are arranged in sets of three on opposite sides of the valve seat lobes of reed block 38, with the inlet ports in one set being disposed radially opposite the inlet ports in the other set. As shown, two sets of three ports 40 are provided for each induction passage 37. With reed block 38 mounted to the crankcase of engine 10, the inlet ports 40 are in communication with induction passages 37. Ports 40 are arranged such that one set of three ports is on one side of the longitudinal axis of engine 10 as defined by crankshaft 12, and the other set of three ports is on the other side.

A single reed valve member 42 (FIGS. 3, 4) is adapted for mounting to each valve seat lobe of reed block 38. As shown, each reed valve 42 includes six petals 44. Each reed valve 42 is mounted on the inside of reed block 38 between inlet ports 40 and crankcase compartment 20, so as to normally close inlet ports 40 and to open in response to low pressure within crankcase compartments 20. As shown in FIG. 4, a pair of dowels 46 are inserted through a reed retainer 48 and into a pair of passages 50 formed in reed block 38. This structure fixes reed valve 42 so that its petals 44 cover inlet ports 40. A tab washer 52 is positioned over reed retainer 48, and a threaded screw 54 extends through tab washer 52 and reed retainer 48 and into a threaded opening 56 provided in reed block 38, for affixing reed 42 thereto. Tab washer 52 preferably includes a tab adapted to be bent upwardly after screw 54 is secured within opening 56 so as to lock screw 54 against rotation.

Each reed valve petal 44 is equidistant from a center point coincidental with the longitudinal axis of opening 56 and screw 54, which is offset from the longitudinal axis of induction passage 37 when induction manifold casting 36 and reed block 38 are fixed to engine 10.

As shown, a single reed valve 42 having outwardly extending petals 44 is provided for each valve seat lobe 38. This differs from the system as shown in U.S. Pat. No. 4,408,579, which employs three separate reed valves per valve seat, each reed valve having three petals. With the system of the present invention, the reed petals 44 do not bend at 90° to the grain of the steel when in their open position to admit air-fuel mixture to crankcase compartment 20, thus allowing use of the single reed valve. In the system of U.S. Pat. No. 4,408,579, a single reed valve could not be used due to the circular arrangement of the intake ports, in that some of the reed valve petals would have to flex at 90° to the grain of the steel. Accordingly, the present invention provides a reed valve assembly which is simpler in its components and assembly by providing the single reed valve and only two dowels for fixing it in position.

Because valve petals 44 are symmetrically positioned in the induction system, each will be generally equally stressed during operation.

Flared flow modifying bodies 58 are formed on reed block 38, each projecting forwardly into induction passages 37 upstream of intake passage 40. Flow modifying bodies 58 each have a top 59 and a pair of sloping sides 60, 62 extending between end portions 64, 66. Sides 60, 62 of flow modifying body 58 slope toward openings 40.

Figure 5:
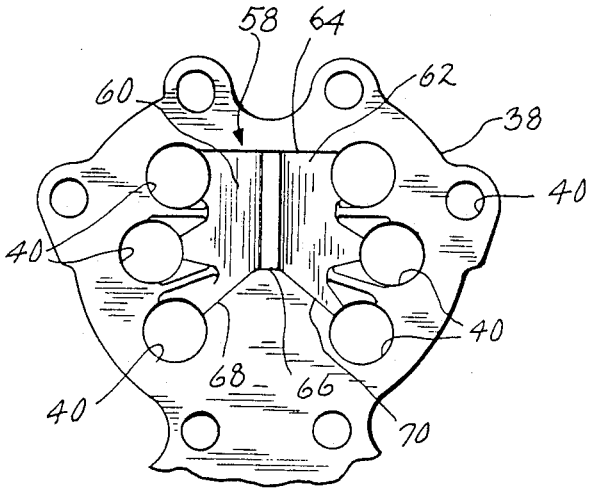
FIG. 5 is a partial top plan view of the reed block, showing the valve ports and the flow modifying body.

FIG. 5 illustrates a partial top plan view of reed block 38, showing the relationship of flow modifying body 58 to intake ports 40. Flow modifying body 58 provides efficient flow of air-fuel mixture downwardly to ports 40. As shown, flow modifying body 58 is recessed at end 66, and portions 68, 70 extend downwardly from end 66 to direct air-fuel mixture to the lower ports 40.

Figure 6:
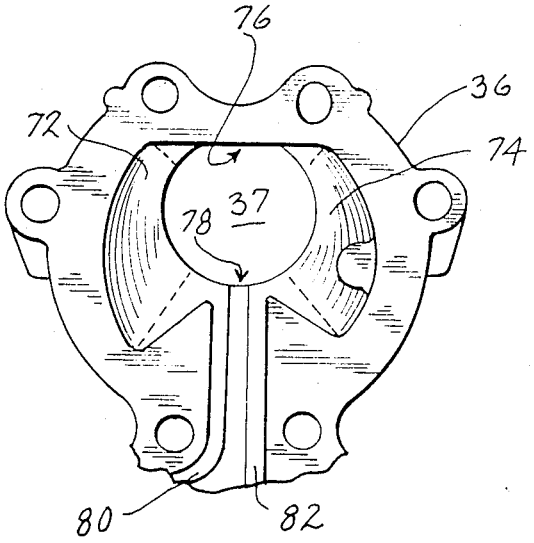
FIG. 6 is a partial bottom plan view of the induction manifold casting showing the induction passage.

FIG. 6 illustrates the underside of a portion of induction manifold casting 36. Each induction passage 37 in casting 36 includes a pair of outwardly sloping side portions, shown at 72, 74 which provide a constantly increasing intake area in a direction toward the crankcase of engine 10. A substantially flat end wall 76 and an inverted V-shaped end wall 78 are disposed between induction passage side portions 72, 74. When reed block 38 and induction manifold casting 36 are mounted to engine 10, as shown in FIG. 1, end 64 of flow modifying body 58 is positioned adjacent induction passage end wall 76, and end 66 of flow modifying body 58 is positioned adjacent induction passage end wall 78. When reed block 38 and induction manifold casting 36 are mounted to the engine 10, flow modify body 58 projects forward into the induction passage 37. Together, the flow modifying body 58 and the induction manifold casting 36 provide a constantly decreasing intake area as the reed valves 42 are approached. Each of induction passage side portions 72, 74 is adapted to receive one of the sets of intake ports 40 to allow passage of air-fuel mixture through ports 40 and into crankcase compartments 20.

Passages 80, 82 are formed in the underside of induction manifold casting 36 for balancing vacuum pulses between the cylinders 14.

Various alternatives and modifications are contemplated as being within the scope of the following claims particularly pointing out and distinctly claiming the subject matter regarded as the invention.

I claim:

1. A two-stroke cycle, crankcase compression engine comprising:

a crankshaft;

a crankcase surrounding said crankshaft;

an induction passage for supplying air-fuel mixture to said crankcase;

air-fuel mixture supply means for supplying air-fuel mixture to said induction passage; and reed valve means mounted in said induction passage between said crankcase and said induction passage, said reed valve means including a reed block having a plurality of ports arranged in oppositely spaced sets, each set comprising a plurality of spaced ports, and a plurality of reed valves, each normally closing one of said ports and opening in response to low pressure within said crankcase to admit air-fuel mixture thereto, wherein said reed valve means comprises a single valve member having a plurality of reed valve petals extending outwardly therefrom comprising said plurality of reed valves, said petals being disposed over said valve ports.

2. The engine of claim 1, wherein the ports in said oppositely spaced sets of ports are disposed so as to be substantially radially opposite one another.

3. The engine of claim 2, wherein the ports in said oppositely spaced sets of ports are equidistant from a center point therefore being offset from the axis of said induction passage.

4. The engine of claim 1, wherein said reed block comprises a plurality of valve seat lobes, each said valve seat lobe being provided with a pair of oppositely spaced sets of ports.

5. The engine of claim 4, wherein said ports are arranged so that one set of ports is on one side of the longitudinal axis of said engine and the other set is on the other side of the longitudinal axis of said engine.

6. The engine of claim 1, wherein said induction passage provides an increasing dimension as it approaches said reed valve means.

7. The engine of claim 6, wherein said induction passage flares toward said reed valve means.

8. The engine of claim 7, wherein said induction passage includes a pair of oppositely disposed flared portions, and wherein one of said oppositely spaced sets of ports is in communication with each said flared portion of said induction passage.

9. The engine of claim 6, further comprising a flow modifying body mounted in the flare of said induction passage immediately upstream from said reed valve means for directing air-fuel mixture into said ports.

10. The engine of claim 9, wherein the transverse dimension of said flow modifying body increases in the downstream direction toward said reed valve means.

11. The engine of claim 10, wherein said flow modifying body is integrally formed with said reed block.

12. The engine of claim 1, wherein said reed valve includes a section of reduced area between the central portion thereof and each petal for reducing the stiffness of said reed valve.

13. The engine of claim 1, wherein said air-fuel mixture supply means comprises a carburetor having a barrel, said barrel having an axis substantially aligned with the axis of said induction passage.

* * * * *